US005435257A

United States Patent [19]

Wincze

[11] Patent Number: 5,435,257

[45] Date of Patent: Jul. 25, 1995

[54] APPARATUS FOR INTRODUCING GAS RECIRCULATION INTO A FURNACE

[75] Inventor: Steven P. Wincze, Windsor, Conn.

[73] Assignee: Combustion Engineering, Inc., Windsor, Conn.

[21] Appl. No.: 169,856

[22] Filed: Dec. 17, 1993

[51] Int. Cl.[6] ..... F23B 5/02

[52] U.S. Cl. ..... 110/204; 110/171; 431/115

[58] Field of Search ..... 110/171, 204, 205, 206, 110/165 R; 431/115, 116

[56] References Cited

U.S. PATENT DOCUMENTS

| | | | |
|---|---|---|---|
| 4,286,548 | 9/1981 | Brash | 110/204 X |
| 4,494,468 | 1/1985 | Rickard | 110/204 X |
| 5,241,916 | 9/1993 | Martin | 110/204 X |

*Primary Examiner*—Edward G. Favors
*Attorney, Agent, or Firm*—Robert S. Smith

[57] ABSTRACT

Apparatus for cooperation with an associated furnace having the capability of burning either coal or oil wherein the improvement includes a coutant having an opening in the bottom thereof. An extended ash hopper is disposed under the coutant. The hopper includes a portion that extends beyond the coutant and a furnace sidewall that abuts an end of the coutant. The ash hopper is generally registered with respect to the opening and the apparatus includes apparatus for conducting gases to be recirculated including a recirculation fan, a duct coupling the apparatus for conducting to the ash hopper; and apparatus for sealing the portion with respect to the duct. In some forms of the invention the duct enters the laterally extending portion through the top thereof. The apparatus for sealing may include first apparatus for receiving a liquid and apparatus for sealing includes at least a first plate fixed to and depending form the coutant. The first apparatus for receiving may include a trough disposed in generally registered relationship to the first plate. The apparatus for sealing may include a second plate disposed in depending relationship from the coutant and fixed to the coutant. The duct may have a generally inverted U-shape. In some forms of the invention the hopper further includes a second portion extending beyond the coutant and a second furnace sidewall.

15 Claims, 3 Drawing Sheets

APPARATUS FOR INTRODUCING GAS RECIRCULATION INTO A FURNACE

TECHNICAL FIELD

The invention relates to furnaces such as those used in power generation apparatus and more particularly to apparatus for introducing gas recirculation in a furnace which can be fired by either coal or oil. When such furnace apparatus is burning oil, the initial combustion process does not burn all of the fuel. Accordingly, it is traditional when burning oil fuels in such furnace apparatus to recirculate the initial combustion gases into the furnace in order to extract additional energy from the fuel that is not completely burned.

The prior art approach to this problem is to introduce the recirculated gases through a gas recirculation fan located near the coutant of the furnace, into ducts extending the full width of the furnace. This requires that the "A-frame" supports at the bottom of the furnace bottom to be designed around them to permit entrance into the furnace through offset tube openings in the coutant bottom. These prior art ducts are exposed to radiant heat and accordingly, must be lined with a refractory material. Toggle joints must also be used in this duct system to allow for the downward expansion of the furnace.

When the furnace is firing coal the gas recirculation system is not being used. Prior art systems have used double dampers and seal air to create a positive gas seal for the recirculation fan. More specifically, the conventional apparatus prevents fluid flow from the coutant back through the recirculation duct and recirculation fan by means of dampers and seal air. The double dampers are two separate dampers in axially spaced portions of the same duct. When the dampers are closed to prevent fluid flow, air is forced into the duct intermediate the respective dampers to purge any leakage from the upstream damper. Any leakage is vented into the interior of the furnace. Disadvantages of the known system include the necessity for considerable duct work and for specially constructed A-frames supports.

OBJECTS AND SUMMARY OF THE INVENTION

It is an object of the present invention to provide apparatus which will permit recirculation of the gaseous products of combustion that will be less complex and expensive than the prior art structures.

Another object of the invention is to provide apparatus that will facilitate use in a furnace that permits either gaseous or solid fuel.

It is an object of the invention to eliminate the need for toggle sections to provide for thermal expansion.

Yet another object of the present invention is to eliminate the necessity for double dampers and seal air.

Still another object of the invention is to eliminate the need for refractory material lining the ducting through which the recirculation gases pass.

An additional object of the invention is to minimize the amount of duct work required for the system.

It has now been found that these and other objects of the invention may be attained in apparatus for cooperation with an associated furnace having the capability of burning either coal or oil wherein the improvement includes a coutant having an opening in the bottom thereof. An extended ash hopper is disposed under the coutant and the extended ash hopper includes at least one laterally extending portion that extends laterally with respect to the associated furnace. The extended ash hopper is generally registered with respect to the opening and the apparatus includes means for conducting gases to be recirculated including a recirculation fan, a duct coupling the means for conducting to the extended ash hopper; and means for sealing the laterally extending portion with respect to the duct.

In some forms of the invention the duct enters the laterally extending portion through the top thereof. The means for sealing may include means for allowing relative movement between the extended ash hopper and the coutant. The means for sealing may include first means for receiving a liquid and means for sealing includes at least a first plate fixed to and depending form the coutant. The first means for receiving may include a trough disposed in generally registered relationship to the first plate.

The means for sealing may include a second plate disposed in depending relationship from the coutant and fixed to the coutant. The duct may have a generally inverted U-shape. In some forms of the invention the extended ash hopper further includes a second laterally extending extension. The second laterally extending portion may extend opposite to the first laterally extending portion.

In other forms of the invention the a coutant has an opening in the bottom thereof and ah hopper is disposed under the coutant. The ash hopper is generally registered with respect to the opening. The means for conducting gases to be recirculated may include a recirculation fan. The apparatus may also include a duct coupling the means for conducting to the ash hopper and means for sealing the ash hopper with respect to the duct.

BRIEF DESCRIPTION OF THE DRAWING

The invention will be better understood by reference to the accompanying drawing in which.

DESCRIPTION OF THE PREFERRED EMBODIMENT

Figure 1:
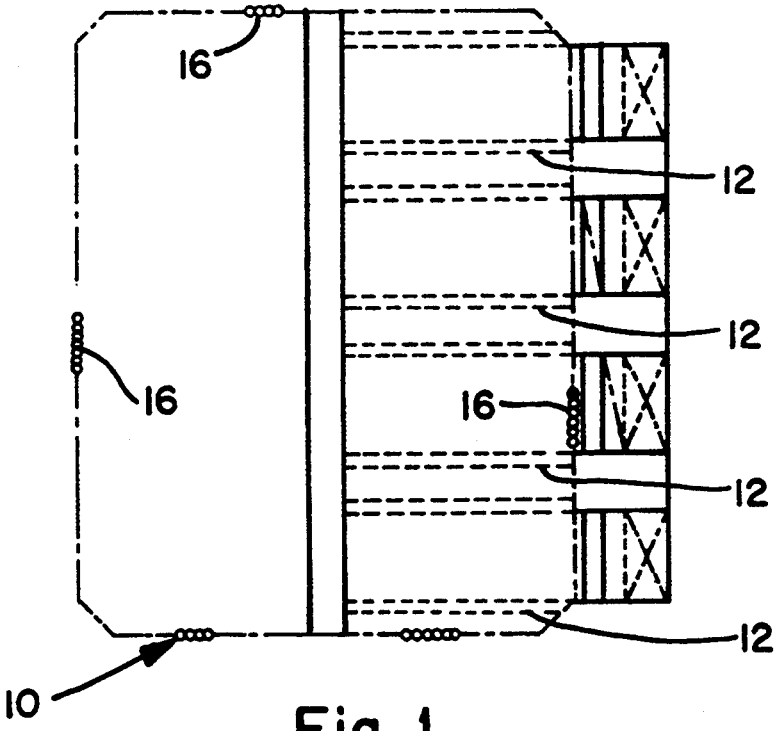
Fig. 1 PRIOR ART
FIG. 1 is plan view of a furnace equipped with the prior art ducts for injecting recirculated air into the furnace.
Figure 2:
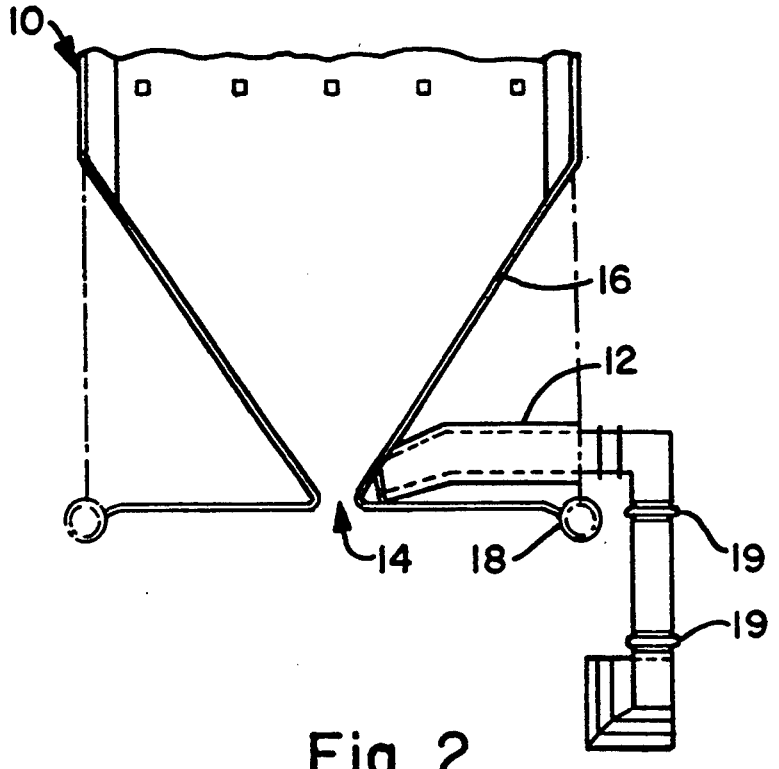
Fig. 2 PRIOR ART
FIG. 2 is an elevational view of the apparatus shown in FIG. 1 which further illustrates the prior ad apparatus for injecting recirculated gas.

In the prior art apparatus shown in FIGS. 1 and 2, four refractory lined ducts 12 are disposed in side abutting relationship. They each direct recirculation gases 12 into the coutant 14 of the furnace 10. It will be understood that these recirculation gases are inserted into the furnace 10 at an elevation that is lower than the conventional fuel nozzles for oil or coal. More specifically, the ducts 12 are positioned to extend to the bottom of the coutant 14 which is formed by a plurality of tubes 16 which are in fluid communication with a header 18. Typically, at least some of the tubes 16 will be spread apart from the conventional mutually parallel coplanar array to allow positioning of the inlet ducts 12 and thus direction of the recirculated gas into the coutant 14. The conventional arrangement of the coutant 14 is V-shaped cross section structure defined by many tubes 16 that conduct a fluid that absorbs the heat of combustion. It will be seen that this structure has a substantial amount of duct work directing the recirculation gases into the furnace 10. More specifically, the entire side of the furnace 10 will have side abutting inlet ducts 12 positioned for injecting the recirculation gas into the furnace. This is best shown in FIG. 1.

Because the ducts 12 are physically attached to the coutant 14, this prior art structure will typically require toggle joints 19 to compensate for the expansion and contraction of the tubes 16. Those skilled in the art will recognize that the tubes 16 have substantial length and are exposed to a wide ranges of temperatures. Thus, thermal expansion is substantial and thus the necessity for the toggle joints 19.

Figure 3:
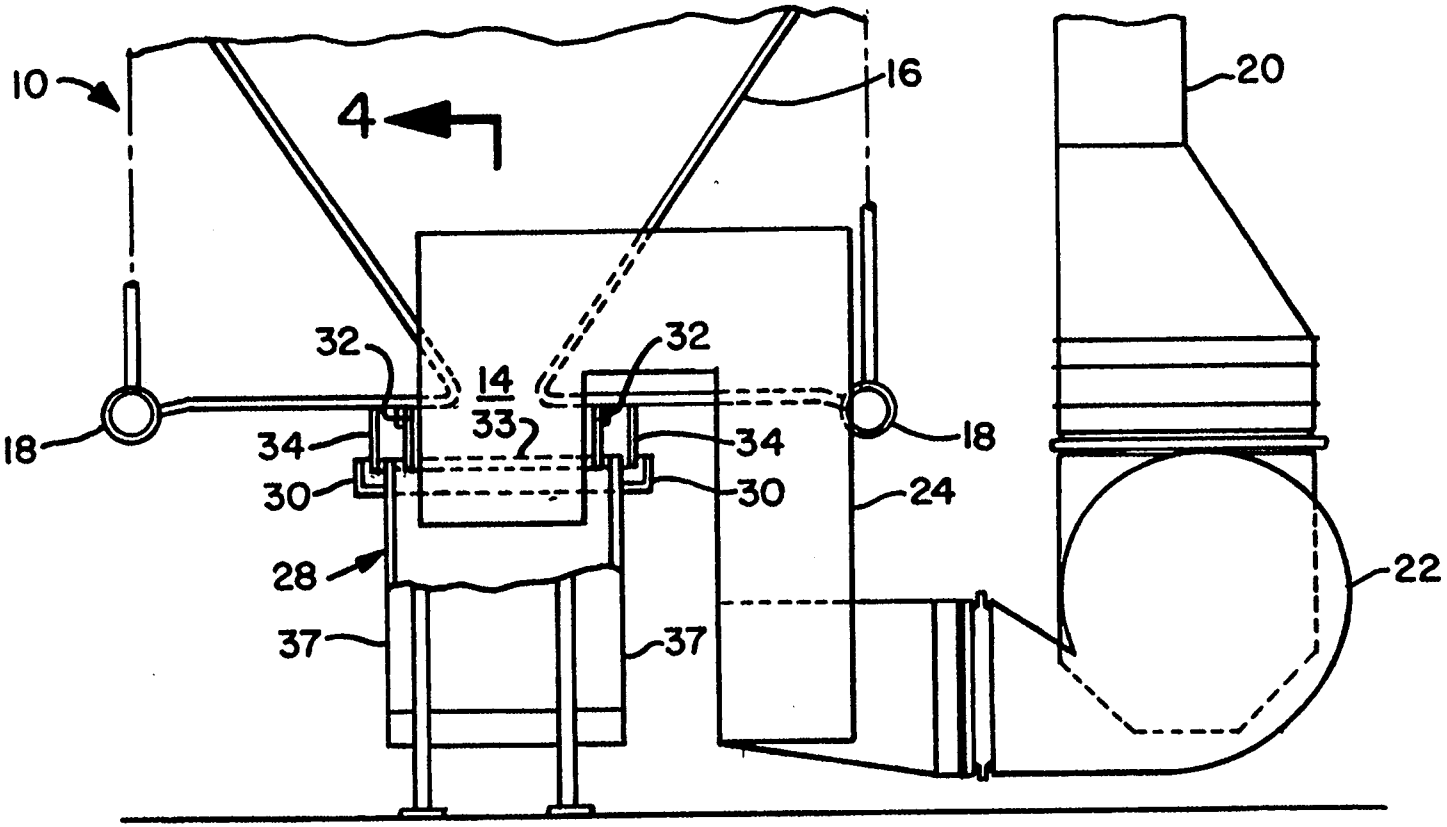
FIG. 3 is an elevational view illustrating the structure in accordance with one form of the present invention for injecting recirculated gases into the furnace.
Figure 4:
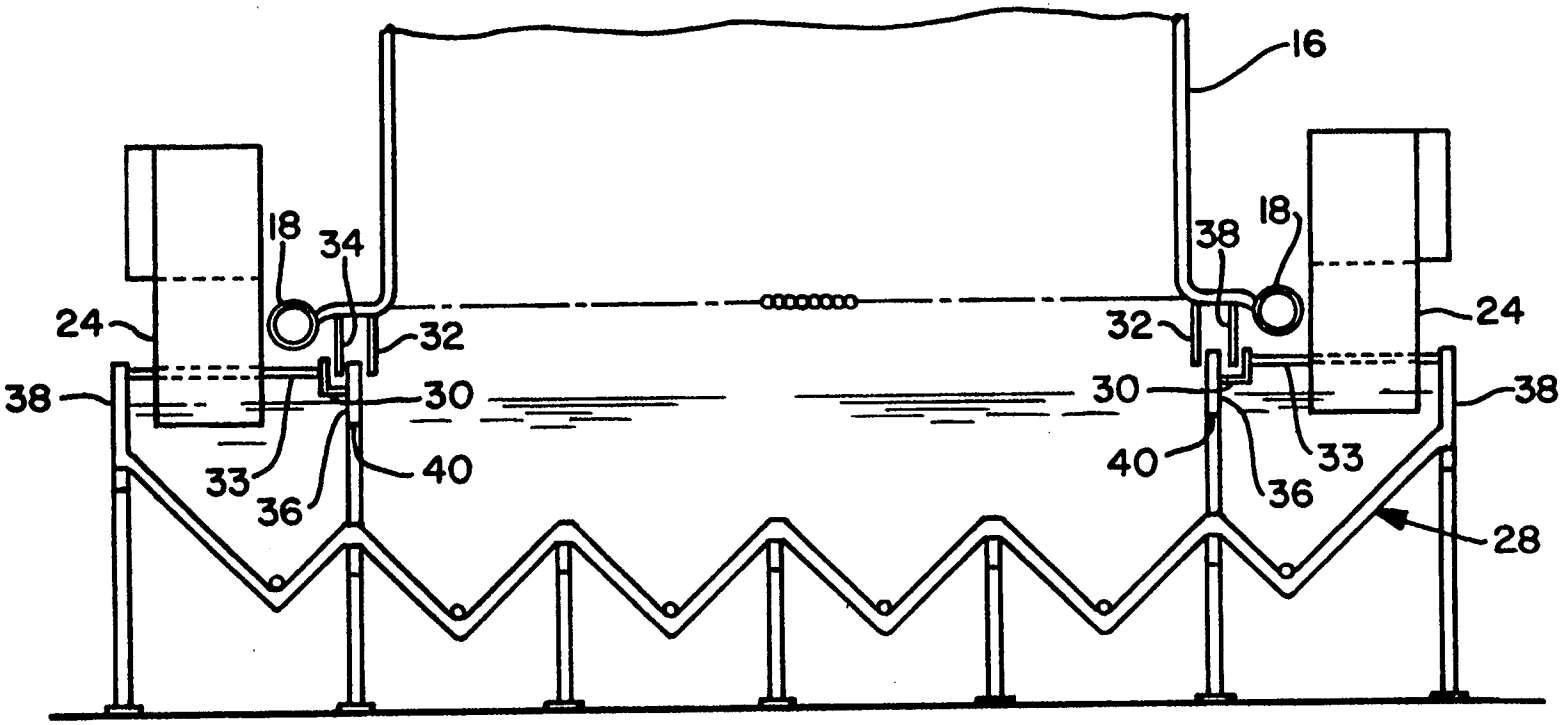
FIG. 4 is another elevational view taken along the line 4—4 of FIG. 3 and which further illustrates the recirculating apparatus of FIG. 3.

The apparatus in accordance with one form of the present invention is shown in FIGS. 3 and 4. The recirculation gases are directed by a duct 20 to a recirculation fan 22 and thence to a gas recirculation duct 24 to introduce the recirculation gases into an extended ash hopper 28. More specifically, the duct 24 has a generally inverted U-shape with the axial extremity thereof extending into the extended ash hopper 28. When the furnace apparatus is burning coal the lowermost extremity of the duct 24 will be submerged in water in the ash hopper 28 to maintain the required seal.

The extended ash hopper 28 extends beneath the coutant 14. As noted above, the conventional arrangement of the coutant 14 is V-shaped cross section structure defined by many tubes 16 that conduct a fluid that absorbs the heat of combustion. In other words the V-shaped cross section is defined by two generally planar walls that are each (a) oblique to and (b) converging toward a vertical plane (not shown) that extends intermediate these walls. The walls of the coutant 14 are spaced from the vertical plane. Because the coutant 14 is generally V-shaped and extends the width of the furnace 10 the V-shaped coutant defines an elongated slot which is bisected by the vertical plane. The extended ash hopper 28 is disposed beneath the slot defined by the coutant 14. In addition the extended ash hopper 28 extends beyond the opposed sides of the furnace 10. (In other words, the extended ash hopper extends beyond the axial extremities of the coutant as well as the side walls of the furnace 10 that abut the axial extremities of the coutant. ) The portions of the extended ash hopper that extend beyond the walls may be considered as lateral extensions since they are extensions of the conventional form of ash hopper and they extend laterally with respect to the furnace 10.

The gas recirculation duct 24 is not attached to the boiler and therefore does not need any toggle sections 19 to allow for any boiler movement. In addition the duct 24 is not exposed to the radiant heat to which the prior art duct 12 is exposed. Thus, there is no need to line the duct 24 with a refractory material.

Depending from the bottom of the coutant 14 are two parallel spaced apart plates 32, 34 that register respectively with (1) a trough 30 and (2) the extended ash hopper 28. The plates 32, 34 are respectively a slag shield and a seal plate. As will be apparent from FIGS. 3 and 4 the extended ash hopper is generally rectangular and elongated just as the "slot" at the bottom of the coutant 14 is elongated. As will be seen from FIG. 3 the trough 30 extends along the longer opposed sides of the "slot" defined by the coutant 14. This portion of the trough 30 is carried on the longer opposed outer walls 37 of the extended ash hopper 28. As will be apparent from FIG. 4 the extended ash hopper 28 extends beyond the trough 30 on the shorter sides of the "slot" defined by the coutant 14. In other words, the trough 30 has the short sides thereof carried on parallel spaced walls 36 of the extended ash hopper. The walls 36 are each parallel to and spaced from the outer extremities 38 of the extended ash hopper 28.

The plates 32, 34 are welded to the bottom of the coutant 14. They cooperate respectively with the extended ash hopper 28 and the trough 30 to maintain a fluid seal as the coutant 14 moves up and down relative to the extended ash hopper 28. It will be understood that the water in the trough 30 and the construction of the trough 30 are conventional and that water is always disposed in the trough 30. The movement of the coutant 14 up and down relative to the extended ash hopper 28 occurs as temperatures in the furnace 10 vary during the operating cycle of the furnace. It will be understood that a plate 33 is fixed to the lowermost extremity of the gas recirculation duct 24. The plate 33 is also welded to the trough 30 and the outer extremities 38 of the extended ash hopper 28 as best seen in FIG. 4.

When the furnace 10 is firing coal the extended ash hopper 28 and the trough 30 are filled with water. The cooperation between the water in the extended ash hopper 28 and the water in the trough 30 respectively and the plates 32, 34 provides the fluid seal that prevents gases from exiting the coutant 14 to ambient or entering the coutant 14 from the ambient. When the furnace apparatus is burning coal the lowermost extremity of the duct 24 will be submerged in water in the ash hopper 28 to maintain the required seal. The seal between the lower extremity of the duct 24 and the water in the ash hopper 28 avoids the need for the system of double dampers and seal air in the prior art apparatus.

When the furnace 10 is firing oil, water in the ash hopper 28 is drained to allow the recirculation gas to flow into the furnace 10 through the bottom of the coutant 14. More specifically, the duct 24 directs recirculation gases into the top of each lateral extension of the hopper 28. The recirculation gases will then pass through respective openings 40 and into the coutant 14. This does not require any offset tube openings and does not require ducts passing through the furnace bottom "A-frame" supports.

The invention eliminates the need for double dampers and seal air. The location of the gas recirculation duct eliminates the need for refractory as the ducts will not be exposed to any radiant heat from the furnace.

The invention has been described with reference to its illustrated preferred embodiment. Persons skilled in the ad of such devices may upon disclosure to the teachings herein, conceive other variations. For example the ash hopper 28 may extend merely from one side of the furnace 10 to the other side of the furnace. In such embodiment the duct 24 may enter the side of the ash hopper instead of entering the top of the lateral extension thereof. Other embodiments may have a single lateral extension rather than the two opposed lateral extensions in the preferred embodiment. Such variations are deemed to be encompassed by the disclosure, the invention being delimited only by the following claims.

Having thus described our invention, I claim:

1. Apparatus for cooperation with an associated furnace having the capability of burning either coal or oil, the furnace having a coutant having an opening in the bottom thereof; the opening being elongated and generally rectangular with first and second opposed sides that are shorter than the sides thereof intermediate said first and second opposed sides, the furnace having first and second opposed sidewalls substantially abutting respectively the first and second opposed sides of the opening, wherein the improvement comprises:

an elongated ash hopper disposed under said coutant, said elongated ash hopper being disposed substantially below the opening, said elongated ash hopper further including a first portion extending beyond the first side of the opening and the sidewall abutting the first side, means for conducting gases to be recirculated, said means for conducting including a recirculation fan;

a duct coupling said means for conducting to said first portion of said elongated ash hopper; and means for sealing said first portion with respect to said duct.

2. The apparatus as described in claim 1, wherein:

said duct enters said first portion through the top thereof.

3. The apparatus as described in claim 2, wherein:

said means for sealing includes means for allowing relative movement between said elongated ash hopper and said coutant.

4. The apparatus as described in claim 3, wherein:

said means for sealing includes first means for receiving a liquid.

5. The apparatus as described in claim 4, wherein:

said means for sealing includes at least a first plate fixed to and depending form said coutant.

6. The apparatus as described in claim 5, wherein:

said first means for receiving includes a trough disposed in generally registered relationship to said first plate.

7. The apparatus as described in claim 6, wherein:

said means for sealing includes a second plate disposed in depending relationship from said coutant and fixed to said coutant.

8. The apparatus as described in claim 7, wherein:

said duct has a generally inverted U-shape.

9. The apparatus as described in claim 8, wherein:

said elongated ash hopper further includes a second portion extending beyond said second side of the opening and the second sidewall abutting said second side of the opening.

10. Apparatus for cooperation with an associated furnace having the capability of burning either coal or oil, the furnace having a coutant having an opening in the bottom thereof; the opening being elongated and generally rectangular with first and second opposed sides that are shorter than the sides thereof intermediate said first and second opposed sides, the furnace having first and second opposed sidewalls substantially abutting respectively the first and second opposed sides of the opening, wherein the improvement comprises:

an elongated ash hopper disposed under said coutant, said ash hopper being generally registered with respect to the opening;

means for conducting gases to be recirculated including a recirculation fan;

a duct coupling said means for conducting to said ash hopper; and means for sealing said ash hopper with respect to said duct; said means for sealing including means for allowing relative movement between said extended ash hopper and said coutant; said means for sealing includes first means for receiving a liquid; said means for sealing including first and second generally planar, generally parallel plates that are each fixed to and depending form said coutant.

11. The apparatus as described in claim 1, wherein:

said first means for receiving includes a trough disposed in generally registered relationship to said first plate.

12. The apparatus as described in claim 11, wherein:

said duct has a generally inverted U-shape.

13. The apparatus as described in claim 12, wherein:

said hopper further includes a first portion extending beyond said coutant past said first side and said first sidewall.

14. The apparatus as described in claim 13, wherein:

said hopper further includes a second portion extending beyond said second side and said second sidewall.

15. The apparatus as described in claim 14, wherein:

said first and second portions are disposed in opposed relationship.

* * * * *